United States Patent [19]

Mandel

[11] Patent Number: 4,519,145

[45] Date of Patent: May 28, 1985

[54] ELECTROSTATIC AND MOISTURE CONTROL SYSTEM FOR AUTOMATIC CLOTHES DRYERS

[75] Inventor: Sheldon W. Mandel, Galesburg, Ill.

[73] Assignee: Magic Chef, Inc., Cleveland, Tenn.

[21] Appl. No.: 588,335

[22] Filed: Mar. 12, 1984

[51] Int. Cl.[3] ..... F26B 3/04

[52] U.S. Cl. ..... 34/27; 34/32; 34/50

[58] Field of Search ..... 34/86, 46, 50, 26, 27, 34/32, 35

[56] References Cited

U.S. PATENT DOCUMENTS

| | | | |
|---|---|---|---|
| 2,688,806 | 9/1952 | Long | 34/75 |
| 2,701,421 | 2/1955 | Erickson et al. | 34/45 |
| 2,818,719 | 1/1958 | Cline | 34/86 |
| 3,266,166 | 8/1966 | Fuhring | 34/32 |
| 3,468,036 | 9/1969 | Blaettler | 34/50 |
| 3,732,628 | 5/1973 | Blevens et al. | 34/32 |
| 3,875,679 | 4/1975 | Condit | 34/75 |
| 3,875,681 | 4/1975 | DePas | 34/75 |
| 3,972,128 | 8/1976 | Vanicek | 34/32 |
| 4,145,818 | 3/1979 | Kulling | 34/10 |
| 4,148,147 | 4/1979 | Steffen | 34/27 |
| 4,154,003 | 5/1979 | Muller | 34/32 |
| 4,168,579 | 9/1979 | Ericsson | 34/46 |
| 4,241,515 | 12/1980 | Wochnowski et al. | 34/28 |
| 4,329,788 | 5/1982 | Sterlini | 34/27 |
| 4,348,174 | 9/1982 | Spigarelli | 34/27 |
| 4,426,791 | 1/1984 | Coppa | 34/77 |

*Primary Examiner*—Larry I. Schwartz

*Attorney, Agent, or Firm*—Bacon & Thomas

[57] ABSTRACT

Buildup of static electricity and uniform drying of a clothes dryer are controlled by condensing moisture from the exiting air stream and later injecting it into a recirculating air stream before the clothes become over-dried.

11 Claims, 1 Drawing Figure

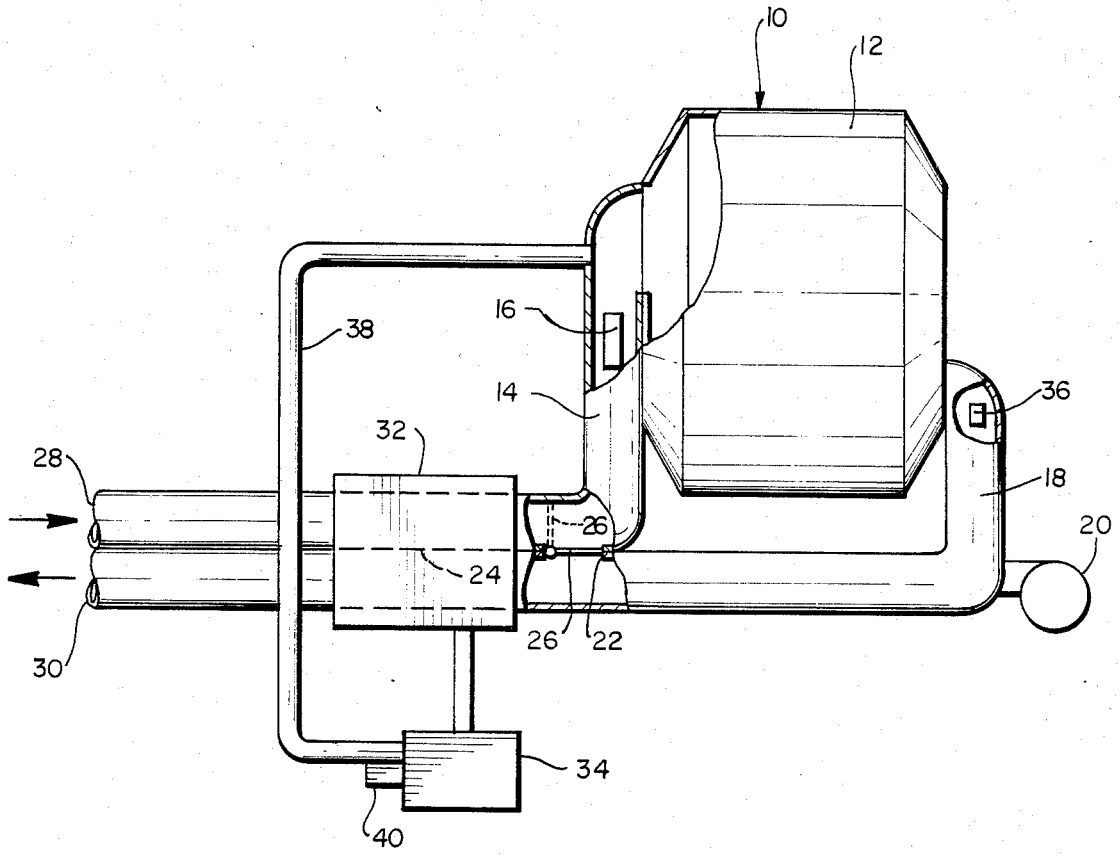
10
12
16
38
14
36
32
28
18
26
20
24
26
22
30
34
40

ELECTROSTATIC AND MOISTURE CONTROL SYSTEM FOR AUTOMATIC CLOTHES DRYERS

BACKGROUND OF THE INVENTION

1. Field of the Invention

The invention generally involves systems for conditioning materials during a drying operation. In particular, it relates to controlling the moisture content of clothes which are being dried in order to eliminate static electricity by preventing overdrying, while allowing adequate drying time for articles which are more difficult to dry.

2. Description of the Prior Art

A typical domestic clothes dryer uses a rotating drum to tumble clothes while exposing them to a heated stream of air. The clothes become dry by losing their moisture to the air stream. It has been difficult to determine the proper length of the drying cycle because of differences in load size and consistency. Employment of dryness sensors has been inadequate in overcoming this problem because of difficulties in sensing dryness accurately and in uniformly drying a non-homogeneous load of clothes.

In the past, the most common approach to overcoming these difficulties has been to time the drying cycle so as to assure dryness of each and every item of clothing in the load. In assuring total dryness, this procedure overdries the clothes and creates the buildup of an electrostatic charge which causes the clothes to cling to each other. There have been proposed solutions to the problem of overdrying based on preconditioning the incoming air prior to its use in the dryer. For example, conditioning the air of a dry cleaning drum in order to prevent excessive drying of goods is taught by the Fuhring U.S. Pat. No. 3,266,166.

However, heretofore known procedures have not been fully adequate in both eliminating the buildup of static electricity in clothes during a drying operation and permitting uniform drying of the clothes.

SUMMARY OF THE INVENTION

It has been discovered that, while tumbling of clothes in a dryer to an overdried state causes buildup of static electricity in the clothes, the addition of moisture to the clothes at the end of a drying cycle not only prevents the buildup of static electricity but also permits the uniform drying of all the clothes, including those that are more difficult to dry.

In accomplishing the foregoing, the present invention removes moisture from air exhausted by a clothes dryer by cooling the exhaust air and collecting the moisture in a condensate trap. After the clothes have been dried sufficiently to actuate a temperature sensor, the collected moisture is injected into the dryer drum to eliminate static electricity by increasing moisture level and permitting uniform drying of all the clothes. During moisture injection, the dryer exhaust air is recirculated through the dryer to serve as the drying air stream.

BRIEF DESCRIPTION OF THE DRAWING

The single FIGURE is a schematic side elevational view of a conventional automatic clothes dryer, shown partly in section, having a preferred embodiment of the invention incorporated therein.

DETAILED DESCRIPTION OF THE PREFERRED EMBODIMENT

The single FIGURE shows a domestic automatic clothes dryer incorporating a preferred embodiment of the invention. Clothes dryer 10 has a conventional drying chamber 12 which tumbles clothes while they are drying in a heated stream of air. Air inlet 14 is a conduit which directs air past a conventional heating device 16 to warm the air prior to its passage through drying chamber 12. After passing through drying chamber 12, the air is directed along air exhaust 18, a conduit which contains a conventional fan 20 for powering the air flow.

A passageway 22 is provided in common wall 24 for providing communication between air inlet 14 and air exhaust 18. An air flow diverter system includes a flap valve 26 which can be positioned in two modes. In the first mode, flap valve 26 is in a horizontal position in which it blocks passageway 22 in common wall 24. This mode allows a flow pattern in which new air is drawn in through entrance 28 and in which air exhausted from drying chamber 12 leaves through exit 30.

The juxtaposition of the relatively warm air exhaust 18 and the relatively cool air inlet 14 along common wall 24 creates a heat exchanger 32 which cools and condenses the moisture in the air passing through air exhaust 18. The condensate is collected in a condensate trap 34.

A second mode of operation is commenced after a temperature sensor 36, located in the air exhaust 18, indicates that the clothes have reached a certain level of dryness. This type of sensor is conventional and works on the principle that the temperature of the air in the air exhaust is directly related to the dryness of the clothes. When the temperature in the air exhaust reaches the value which corresponds to the desired degree of dryness of the clothes, the second mode of operation begins.

In the second mode, flap valve 26 is moved to a vertical position, as shown in dotted lines, and blocks entrance 28 to air inlet 14 so that air is recirculated from air exhaust 18 through air inlet 14 to drying chamber 12. Moisture from condensate trap 34 is injected into drying chamber 12 through moisture injection tube 38 by using a conventional pump 40. Therefore, during the second mode of operation, the liquid injection raises the moisture level of the clothes to prevent electrostatic buildup and allow adequate drying time for articles of clothing which are more difficult to dry.

In operation, clothes are loaded into drying chamber 12 in a conventional way, such as through a door in the housing (not shown). The dryer is started by actuating a conventional control switch (not shown) which causes the dryer to commence its first mode of operation. Drying chamber 12 starts to spin and thereby tumble the clothes through the use of a belt drive from an electric motor (not shown). Simultaneously, heating device 16 and fan 20 are energized so that air is drawn in through entrance 28, past heating device 16 where it is heated, through the clothes in drying chamber 12 where it picks up moisture from the clothes, through air exhaust 18 and heat exchanger 32 where moisture is condensed and then collected in condensate trap 34. The air is finally expelled through exit 30. In this mode, flap valve 26 in the air flow diverter is in a horizontal position and blocks passageway 22 in common wall 24 between air inlet 14 and air exhaust 18. The clothes are quickly dried through exposure to a hot dry stream of air. This mode of operation continues until temperature sensor 36 indicates that the clothes have reached a certain level of dryness. At this point, the temperature sensor 36 automatically causes commencement of the second mode of operation.

In commencing the second mode of operation, flap valve 26 in air flow diverter 22 is automatically moved to a vertical position, as shown in the dotted lines, by a conventional valve actuator (not shown) thereby blocking entrance 28 to air inlet 14 and uncovering an opening in common wall 24 between air inlet 14 and air exhaust 18. This changes the flow path of the air in the system so that air is recirculated from air exhaust 18 through opening 22 in common wall 24 into air inlet 14 rather than exiting through exit 30 after passing through heat exchanger 32. This causes the air entering drying chamber 12 to be less dry due to the fact that recycled moist air is being used rather than the fresh drier air which was drawn through entrance 28 from outside the system in the first mode of operation.

The control system for operating flap valve 26 in the air flow diverter and moisture injector 36 is conventional in nature. It may consist of either an electronic microprocessor or an electromechanical switching arrangement.

Other arrangements for an air flow diverter may be used. They include using a double flap valve which, in the second mode of operation may be actuated to block both entrance 28 and exit 30 in establishing a recirculating air pattern.

To further increase the moisture level of the drying chamber, moisture from condensation trap 34 is injected into drying chamber 12, through moisture injection tube 38 by using a conventional pump. The increased moisture level of the clothes prevents buildup of static electricity while allowing adequate drying time for articles of clothing which are more difficult to dry. After a period of time, the second mode of operation automatically terminates and the load of clothes which are now thoroughly dry and free from electrostatic buildup may be removed from drying chamber 12.

What is claimed is:

1. An automatic clothes dryer including a drying chamber, an air inlet, an air outlet, inlet air heating means, outlet air temperature sensing means and air circulating means, the improvement comprising:

(a) means for condensing moisture from the outlet air;
(b) means for storing the condensed moisture;
(c) means for injecting the condensed moisture from the storage means into the air inlet; and
(d) means responsive to the temperature sensing means for activating the moisture injecting means when the outlet air reaches a predetermined temperature, thereby preventing the buildup of static electricity and permitting uniform drying of the clothes.

2. The automatic clothes dryer of claim 1 further comprising means for recirculating the outlet air through the air inlet and whereby said means responsive to the temperature sensing means also actuate the recirculating means when the outlet air reaches a predetermined temperature.

3. The automatic clothes dryer of claim 2 wherein the means for recirculating the outlet air includes a passageway permitting communication between the air inlet and the air outlet, and valve means for selectively opening and closing the passageway.

4. The automatic clothes dryer of claim 1 wherein the means for condensing moisture from the outlet air includes disposing the air inlet and the air outlet in heat exchange relationship with each other.

5. The automatic clothes dryer of claim 1 wherein the means for storing the condensed moisture includes a condensate trap in fluid communication with the air outlet.

6. The automatic clothes dryer of claim 1 wherein the means for injecting moisture from the condensed moisture storage means into the air inlet includes a conduit providing fluid communication between the air inlet and the storage means, and means for pumping the condensed moisture through the conduit and into the air inlet for mixing with the recirculated outlet air.

7. A method of drying clothes in an automatic clothes dryer wherein the clothes are dried in a chamber provided with an air inlet and an air outlet by preheated air circulated through the chamber and controlled by sensing the temperature of the outlet air, the improvement comprising the steps of:

(a) condensing moisture from the outlet air;
(b) injecting the condensed moisture into the air inlet when the outlet air reaches a predetermined temperature, thereby eliminating the buildup of static electricity and permitting uniform drying of the clothes.

8. The method of claim 7 further comprising the step of recirculating the outlet air through the air inlet when the outlet air reaches a predetermined temperature.

9. The method of claim 7 wherein the moisture is condensed from the outlet air through cooling the outlet air by the inlet air in a heat exchange relationship.

10. A method of uniformly drying articles without the buildup of static electricity in a drying chamber having an air inlet, an air outlet and means for circulating preheated air through the chamber, comprising the steps of:

(a) condensing moisture from the outlet air;
(b) sensing the temperature of the outlet air; and
(c) injecting the condensed moisture into the air inlet when the outlet air reaches a predetermined temperature.

11. An apparatus for uniformly drying articles without the buildup of static electricity, which apparatus comprises:

(a) a drying chamber including an air inlet and an air outlet;
(b) means disposed in the air inlet for heating inlet air;
(c) means disposed in the air outlet for sensing the temperature of outlet air;
(d) means for condensing moisture from the outlet air; and
(e) means for injecting the condensed moisture into the air inlet when the outlet air reaches a predetermined temperature.

* * * * *